United States Patent [19]

Casutt

[11] 4,132,346

[45] Jan. 2, 1979

[54] FOLDED-UP PACK FOR FRAGILE ARTICLES

[76] Inventor: Toni Casutt, Kirchweg 46, 8102 Oberengstringen, Switzerland

[21] Appl. No.: 882,186

[22] Filed: Feb. 28, 1978

[30] Foreign Application Priority Data

Mar. 1, 1977 [CH] Switzerland ..... 2525/77

[51] Int. Cl.[2] ..... B65D 5/48

[52] U.S. Cl. ..... 229/28 R; 229/48 R

[58] Field of Search ..... 229/28 R, 48 R

[56] References Cited

U.S. PATENT DOCUMENTS

| | | | |
|---|---|---|---|
| 981,993 | 1/1911 | Gair et al. | 229/48 R |
| 2,884,179 | 4/1959 | Rossum | 229/28 R |
| 3,021,994 | 2/1962 | Wolfe | 229/48 R |
| 3,184,143 | 5/1965 | Kotowick | 229/28 R |
| 3,770,188 | 11/1973 | Norman | 229/69 |
| 3,955,744 | 5/1976 | Casutt | 229/28 R |
| 3,980,221 | 9/1976 | Okada | 229/28 R |

*Primary Examiner*—Stephen P. Garbe
*Attorney, Agent, or Firm*—Flynn & Frishauf; Flynn & Frishauf

[57] ABSTRACT

In a pack for eggs or other fragile articles constructed of corrugated strips glued to and braced by external flat strips, in which the corrugated strips are joined together at their inner apices and folded at these junctions after the manner of U.S. Pat. Nos. 3,955,744 and 3,983,680, the closure of the pack is made along one of the narrower sides instead of along one of the wider sides, and at least one of the abutting narrow flat strips is provided with tongues of a length greater than the width of the strip that are stamped out of the material of one of the wider flat strips. These tongues are bent over so as to overlap the adjoining flat strip, where they can be glued to the flat strip to hold the pack together. The fastening is thus provided out of the material of the pack without waste, and no fasteners or adhesive strips need be applied from an external source in the packing operation.

6 Claims, 4 Drawing Figures

FOLDED-UP PACK FOR FRAGILE ARTICLES

This invention concerns a pack or container for fragile articles, the pack being particularly adapted to the packaging of eggs, but being also useful for the packing of other fragile articles. In particular, the invention concerns egg boxes or packs made of flat and corrugated cardboard strips which can be cut out of one or two raw material strips without any waste and assembled on automatic machinery.

My U.S. Pat. Nos. 3,955,741 and 3,983,680 disclose a pack of the above-described type and a method of making it respectively, in which the corrugated strips are fastened to each other, side by side, only at alternate flat apices of the corrugations, while the remaining flat apices are bonded by adhesive to flat strips of the same width that brace the corrugations and form the smooth outside portions on each of the four flat sides of the pack. The pack is set up by folding the outer portions inward along the boundary lines where the several corrugated strips are joined one to another, the fourth side being folded in only after the pack is loaded. The corners, of course, are left open in such a structure.

In the pack described in my above-mentioned patents, after the fourth side was folded in around the contents of the pack, it was necessary to apply lengths of adhesive strip to hold abutting edges together to maintain the pack in its set-up and closed position. It has however been found that the application of such an adhesive strip in an automatically operating packing machine requires relatively large amounts of space which is generally not available to a sufficient extent in and around packing machines of the types presently known. Furthermore, the replacement of empty adhesive strip rolls with a full roll requires an interruption of operations which is likewise undesirable. Furthermore, in practical and economical operation of packing machines, only a short period of the operating cycle is available for connecting the two abutting corrugated strips and their respective stiffening flat strips.

It is an object of the present invention to overcome the disadvantages above-mentioned and to hold together the abutting corrugated strips of a filled and a fully set-up pack securely without the necessity of applying an adhesive strip from an external source and to accomplish the operation in a very short period of the operating cycle of a packing machine.

SUMMARY OF THE INVENTION

Briefly, quite unlike the pack disclosed in my above-mentioned patent, the central corrugated strip of a plurality of corrugated strips joined together side by side at alternate apices is narrower than the two corrugated strips to which it is connected directly at each side and the latter are each connected, at their respective sides remote from the central strip, to narrower corrugated strips, which are of such width that the total of their width is approximately equal to the width of the central corrugated strip. The corresponding flat strips of course have corresponding widths and, for purposes of accomplishing the desired closure fastening, laterally extended tongues are provided by at least one of the outer narrower strips at that one of its edges which is nearer to the adjacent wider strip than to the other narrower outer strip, each such tongue having a length greater than the width of the outer narrower strip, so that it can be folded over externally when the pack is set up and bonded by adhesive to the adjacent outer narrower strip. Such tongues can easily be made at the expense of stamping out corresponding cut-outs in an adjacent wide strip when the flat strips are made from a continuous strip, without any appreciable impairment of the strength or integrity of the pack.

In this way it is possible to set up a pack partially, fill it, and complete the setting up of the pack in the filled condition without the necessity of providing adhesive strips or the like from other sources and by using only parts stamped out from the packing material itself. In order to accomplish this advantageous arrangement, however, it was necessary to depart from the structure described in my above-mentioned patents by putting the abutment that is to be fastened together on the narrower side of the elongated pack, since only in that case would it be possible to stamp out a tongue from the adjacent side sufficiently long for the tongue to be able to be bent over at its root and extend beyond the abutment to be joined, so that its end can be bonded to the adjacent narrow strip that supports the other of what were originally (before set-up) the outer narrower corrugated strips.

The invention is further described by way of example with reference to the accompanying drawings, in which.

Figure 1:
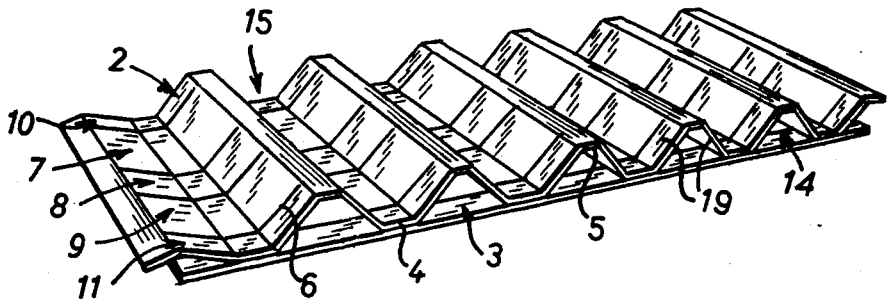
FIG. 1 is a perspective representation of a patent for fragile articles in its unfolded condition.

As shown in FIG. 1, the pack of the present invention is made essentially out of two pieces bonded together, a corrugated strip 2 and a flat strip 3, except that although the corrugated strip is not completely slitted lengthwise into multiple strips, the flat strip, however, is in fact so slit that it does actually come apart into a multiplicity of parallel strips. Both of the strips 2 and 3 preferably consist of cardboard or cardboard-like material of a thickness of about 0.5 mm that can be glued and printed. The tops and bottoms (apices) of the corrugations are flat and the flat region 4 of each corrugation valley is bonded fast to the flat strip 3 with adhesive. A cavity 14 is formed between the flat strip 3 and the two oblique surfaces 19 of each wave of the corrugated strip 2. The wavelength, i.e., the spacing from the middle of one wave valley to the next, corresponds to the article dimension plus the spacing in the longitudinal direction of the pack, which, in the case of egg packs, is preferably about 4.5 cm. In both the corrugated strip 2 and in the flat strip 3, as already mentioned, cuts or slits 6 running parallel in the direction of the long dimension of the pack, are provided, which completely cut through the flat strip 3 and separate it into pieces, but which end just below the corrugation apices (peaks) in the case of the corrugated strip 2. In this manner, there are formed five wave strips located, in FIG. 1, one next to the other, each composed of a corrugated strip 7, 8, 9, 10, 11 and a corresponding flat strip of the same width as the overlying corrugated strip not separately designated in FIG. 1, but which may be referred to by the corresponding reference symbols 7*a*, 8*a*, 9*a*, 10*a* and 11*a*. Each of these wave strips is connected with one or two of the others only at folding junctions 13, namely at alternate apices of the corrugations which alternate with those oppositely directed apices of the corrugations that are bonded to the flat material. Thus, the structure in FIG. 1 may be described as composed of a set of corrugated strips 7, 8, 9, 10 and 11 having flat apices 4 and 5 joined together side by side at alternate apices 5 and each bonded to a flat strip 7*a*, 8*a*, 8*b*, 8*c*, 8*d* of the same width as the corresponding corrugated strip in question at the other alternate apices 4.

It will be convenient to refer to "wave strips", each made up of a corrugated strip and a flat strip of the same width, by the reference numeral of the corrugated strip.

The central wave strip 8 is narrower than the neighboring wave strips 7 and 9 that adjoin it on either side. The total width of the two outermost wave strips 10 and 11 is about the same as the width of the wave strip 8.

Figure 2:
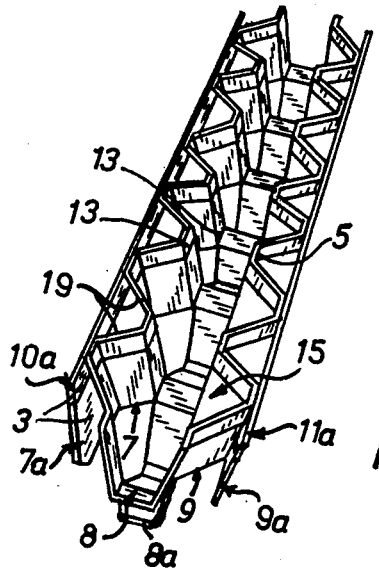
FIG. 2 is a perspective view of the same pack after a first stage of folding.

As shown in FIG. 2, in the first stage of setting up the pack, the corrugated strips 7 and 9 are bent up about the fold edges 13 at the boundaries of these strips where they join onto the corrugated strip 8. All of the fold lines 13, both those just mentioned at the boundaries between the corrugated strip 8 and the corrugated strips 7 and 9, and also those between the latter and the narrower outer strips 10 and 11, where no folding has taken place by the first stage shown in FIG. 2, run parallel to the long dimension of the pack. It is preferably when the pack is in the condition shown in FIG. 2 that the articles to be protected in the pack are loaded into the pocket 15 formed by the corrugated strips at this stage. Thereafter, the two narrow corrugated strips 10 and 11 are bent around each by about 90°, swinging on the respective outer fold lines 13, so that finally a packing is formed having the appearance shown in FIG. 3, where the eggs 18 which were inserted at the stage of FIG. 2, as above mentioned, are surrounded on all four sides by the corrugated strips 7–11. In this kind of pack, ambient air still has access to the articles, which is important for keeping eggs fresh in storage.

The flat strips 7*a*, 8*a*, 9*a*, 10*a*, 11*a* which together with the corresponding corrugated strips, form what may be called the wave strips, lie essentially in planes that intersect to form an enlongated enclosure of rectangular cross-section. Since the corrugations are somewhat elastic, the eggs 18 or other articles packed in the package are to a great extent protected against shock. Furthermore, the pack is able to bear a certain mechanical loading, such as for example the load of stacking many of these packs one upon another.

In order to hold the pack together in its set-up condition, a plurality of tongues 21 are provided on at least one of the outer narrower wave strips, more particularly on the flat strip 10*a* to which the corrugated strip 10 is affixed. These tongues are stamped out of the material of the stock strip 3 (FIG. 1) from the neighboring wider flat strip 7*a* (to which the corrugated strip 7 is affixed). The length of these tongues 21 is greater than the width of the outer strip 10*a*, preferably having a value of about twice the width of the strip 10*a*. These tongues 21 are bent back on a fold line 26 that again runs parallel to the long dimension of the pack, at the root of the tongues, and is bonded by means of an adhesive with the flat strip 11*a* that is alongside the strip 10*a* at the abutment boundary 22. Thus, the bent-over tongues 21 extend over the abutment boundary 22 and hold the set-up pack together. The tongues 21 are integral with one or the other of the flat strips, in this case the strip 10*a*. After the stamping out of the tongues 21, cutout openings 20 are left in the flat strip 7*a*. In order that the places of attachment of the corrugated strip to the flat strip 7*a* should not be weakened, the openings 20 are in each case located in the region opposite an apex 5 where the corrugated strip 7 is joined laterally to other corrugated strips. After the bending-around of the two outer corrugated strips 10 and 11, the tongues 21 lie in the plane of the two flat strips 10*a* and 11*a*. They are then bent over by 180° by a mechanical device (which can readily be provided for that purpose and does not need to be described further here) and are then firmly bonded by means of an adhesive to the adjacent flat strip (in this case the strip 11*a*), an operation that likewise can readily be performed by automatic machinery that does not need to be described for its construction to be understood.

Figure 3:
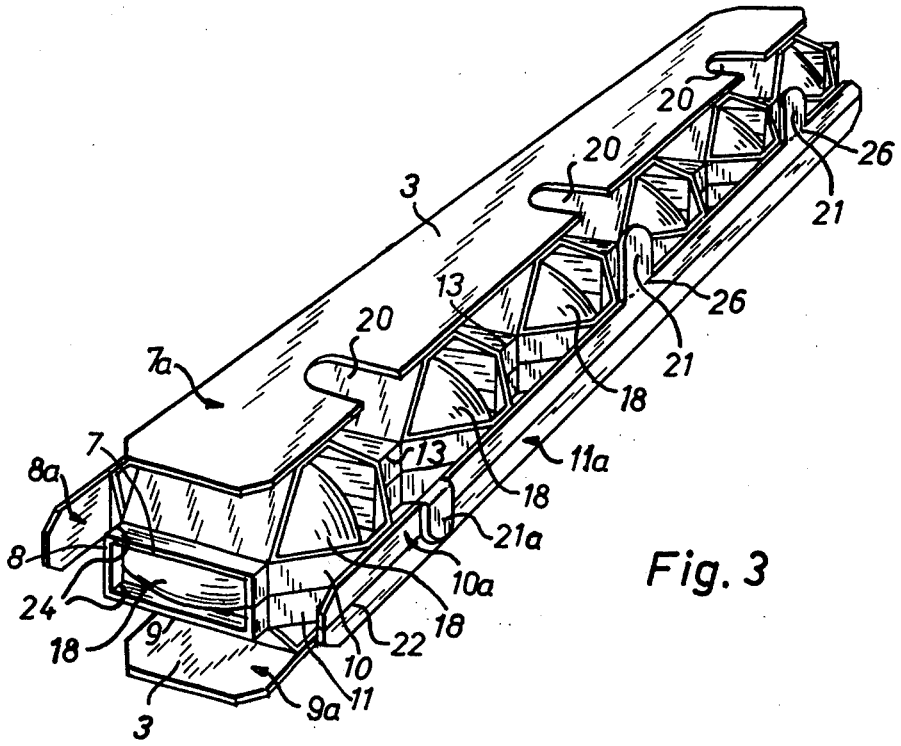
FIG. 3 is a perspective view of the same pack in fully folded condition, with one tongue folded over and bonded to the neighboring strip.
Figure 4:
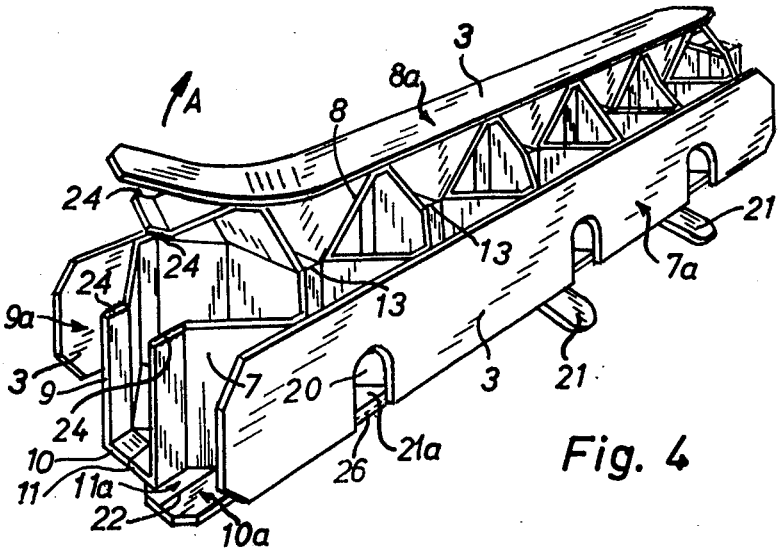
FIG. 4 is a perspective view of the pack of FIG. 3, in a position rotated by 90 degrees about its length axis, from which one corrugated strip has been partly torn away from the others for removing a packed article from the pack.

In FIG. 3, one of the tongues, designated 21*a*, is shown bent over, while the two other tongues 21 are shown still in their extended position before being bent over. Of course, in practice all of the tongues 21 are bent over at the same time, the showing of FIG. 3 and FIG. 4 being, as just described, merely to illustrate the position of the tongues at two different stages of completion of the pack.

No other fastening means besides the glued tongues 21 are necessary or are present in the illustrated case in order to hold the pack together in its set-up condition. The bending over of the tongues 21 is carried out immediately after the bending over of the two outer corrugated strips 10 and 11. The pack, during this operation, stands up in a stable position, i.e., it stands on the strip 8*a* that supports the corrugated strip 8, and during these operations it is practical for it to be carried forward in a direction perpendicular to the long dimension of the pack.

In order to facilitate the removal of individual eggs or other articles contained in a pack such has been described, held closed with glued tongues, the folding lines 13 are constituted so as to serve also as ultimate tearing lines. This can conveniently be done by providing a row of perforations along these lines to weaken the material somewhat at these locations.

Reference is made to my prior patents above mentioned, U.S. Pat. Nos. 3,955,744 and 3,983,680, for further information regarding the preparation of corrugated strips and flat strips, attachment of the corrugated strips to the flat strips, and the folding at the boundaries where the corrugated strips join together, especially as performed by the use of automatic machinery.

Although the pack of the invention has been described particularly with reference to a form suitable for packing eggs, it will be understood that the invention is also applicable to the packing of other fragile or pressure-sensitive articles, such as, for example, fruit, glassware or the like.

I claim:

1. A pack for fragile articles, in particular eggs, comprising a plurality of parallel flat strips and an equal number of corrugated strips each fastened to a flat strip of the same width at alternate apices, said corrugated strips having flat apices and being joined integrally together side by side at alternate apices intermediate said apices attached to said flat strips, the joined-together apices being bent up on fold lines at the strip junctions running in the longitudinal direction of the strips, so that the corrugated strips enfold cavities and the flat strips form the outside of the pack while bracing the corrugations, said pack comprising the improvement which consists in that:

a central corrugated strip (8) is joined on each side at alternate flat apices of the strip to the corresponding apices of a wider corrugated strip (7,9);

each of said wider corrugated strips (7,9) is similarly joined to an outer narrower corrugated strip (10,11) of such width that said two outer narrower corrugated strips (10,11) have a total width approximately equal to the width of said central corrugated strip (8);

at least one (**10*a*) of the flat strips affixed to said outer narrower corrugated strips (10,11) has at least one tongue on its side which is closer to the nearer (7) of said wider corrugated strips (7,9) and the flat strip (7*a*) affixed to said wider corrugated strip (7) which is nearer to said at least one flat strip (10*a*) has at least one lateral cutout corresponding to said at least one tongue, said at least one tongue being longer than the width of the flat strip (10*a*) of which it forms part, being folded over in the neighborhood of its root (26), and having its projecting end bonded to the other flat strip (11*a*) affixed to the other (11**) of said outer narrower corrugated strips for holding said pack in closed condition.

2. A pack for fragile articles as defined in claim 1, in which a total of three said tongues (21) are provided distributed in the length direction of the pack extending from the same edge of the same flat strip and each so located lengthwise of the flat strip as to be substantially opposite of set of joined-together apices of said corrugated strips.

3. A pack for fragile articles as defined in claim 2, in which said tongues (**21*a***) are adhesively bonded at their ends to one of said narrower flat strips for holding said pack in closed condition and constitute the sole means of connection or fastening between said narrower outer corrugated strips or the flat strips to which the latter are affixed.

4. A pack for fragile articles as defined in claim 2, in which fold creases (13) between at least some adjacent corrugated strip apices (7,8,9) provide a connection sufficiently weak to serve as tearing lines (24) for the removal of an individual article (18) from said pack.

5. A pack for fragile articles as defined in claim 4, in which said fold creases (13) are provided where said central corrugated is joined to each of said adjacent wider corrugated strips (7,9).

6. A pack for fragile articles as defined in claim 5, in which said fold creases (13) are provided with perforations to facilitate tearing.

* * * * *